US005971085A

United States Patent [19]

Colebrook

[11] Patent Number: 5,971,085

[45] Date of Patent: Oct. 26, 1999

[54] DOWNHOLE UNIT FOR USE IN BOREHOLES IN A SUBSURFACE FORMATION

[75] Inventor: Mark Colebrook, Cheltenham, United Kingdom

[73] Assignee: Camco International (UK) Limited, United Kingdom

[21] Appl. No.: 08/965,334

[22] Filed: Nov. 6, 1997

[30] Foreign Application Priority Data

Nov. 6, 1996 [GB] United Kingdom ..... 9623032

[51] Int. Cl.[6] ..... E21B 4/02

[52] U.S. Cl. ..... 175/266; 175/267; 175/292

[58] Field of Search ..... 175/23, 263, 266, 175/267, 292

[56] References Cited

U.S. PATENT DOCUMENTS

| | | | |
|---|---|---|---|
| 3,881,776 | 5/1975 | Fashbaugh et al. | 175/94 X |
| 4,776,397 | 10/1988 | Akkerman | 175/325 X |
| 5,725,061 | 3/1998 | Van Steenwyk et al. | 175/104 |

FOREIGN PATENT DOCUMENTS

| | | |
|---|---|---|
| 0530045 | 3/1993 | European Pat. Off. . |
| 2259316 | 3/1993 | United Kingdom . |
| 2289907 | 12/1995 | United Kingdom . |
| 2290097 | 12/1995 | United Kingdom . |
| 9413928 | 6/1994 | WIPO . |

*Primary Examiner*—Roger Schoeppel
*Attorney, Agent, or Firm*—Wayne I. Kanak

[57] ABSTRACT

A downhole unit for use in subsurface boreholes, for example a bias unit for imparting a lateral bias to the drill bit to control the direction of drilling, includes a main body and a number of pads pivotally mounted on the main body for engagement with the walls of the borehole. A thrust member is disposed inwardly of each pivotal pad and is movable along a guide passage in the main body to transmit movement to the pad. Each thrust member is movable by hydraulic pressure and a fluid-tight sliding seal is provided between the thrust member and its guide passage. The outer surface of each thrust member or the inner surface of the guide passage, or both, is in the form of a portion of a toroid centred on the pivot axis of the respective pad so as to minimise lateral movement of the seal as the thrust member moves along the passage. This also allows relative displacement between the thrust member and pad to be avoided, so that the thrust member can be integral with the pad or rigidly connected to it.

16 Claims, 3 Drawing Sheets

DOWNHOLE UNIT FOR USE IN BOREHOLES IN A SUBSURFACE FORMATION

BACKGROUND OF THE INVENTION

1. Field of the Invention

The invention relates to downhole units for use in boreholes in subsurface formations.

2. Description of Related Art

When drilling holes in subsurface formations it may be necessary to utilise, usually as part of the bottom hole assembly, a downhole unit having one or more formation-engaging members which may be extended or retracted relative to the main body of the unit for engagement and disengagement with the wall of the borehole. Such units may also be required for performing operations in a already-drilled borehole. For example, the unit may be a stabilizer or may be part of a bias unit for imparting a lateral bias to the bottom hole assembly, including the drill bit, for the purposes of controlling the direction of drilling.

The downhole unit of the kind to which the present invention relates is a hydraulically operated unit comprising a main body, at least one formation-engaging member mounted on the main body for pivotal movement, about a pivot axis, outwardly and inwardly relative to the main body, a movable thrust member disposed inwardly of the formation-engaging member and movable outwardly and inwardly relative to a guide structure on the main body to transmit movement to the formation-engaging member, means for subjecting the thrust member to hydraulic pressure to effect said movement thereof, and a sealing device between the thrust member and guide structure.

The present invention is particularly, but not exclusively, applicable to modulated bias units of this kind, for use in directional drilling, where the formation-engaging member or members may be periodically extended in synchronism with rotation of the unit, and in selected phase relation thereto so that, as the bias unit rotates, each formation-engaging member is extended outwardly at a selected rotational orientation of the bias unit so as to impart a desired lateral displacement thereto as the bias unit, and the rest of the bottom hole assembly, rotates. British Patent Specifications Nos. 2259316 and 2290097 describe various features of modulated bias units of this type, and also show typical prior art arrangements for the thrust member, guide structure, and sealing device.

However, problems have been experienced with these prior art arrangements. For example, Specification No. 2259316 describes arrangements where the thrust member is in the form of a piston which is linearly slidable in a cylinder, a flexible fluid-tight seal being provided between the piston and cylinder. In the described arrangement, the thrust member itself bears against the formation. If such a thrust member were to be used with a pivoted formation-engaging member, it would be necessary for the engagement between the thrust member and formation-engaging member to be such as to accommodate relative movement between the two components. In the extremely hostile environment downhole, where the components are subjected to high temperature and pressure and to abrasion from the high pressure flow of drilling fluid, rapid wear of the engaging parts of the thrust member and formation-engaging member would occur leading to reduced effectiveness of the operation of the components and ultimately failure.

British Specification No. 2259316 discloses further arrangements where the formation-engaging member is pivoted, and in such cases the thrust member is integral with the formation-engaging member or is rigidly bolted to it. Consequently, as the pivoted formation-engaging member is extended or retracted the thrust member tilts and moves laterally relative to its guide structure, and the sealing device between the thrust member and guide structure must therefore be such as to accommodate such movement.

The most successful arrangement hitherto has been to provide a flexible rolling diaphragm having an annular portion of U-shaped cross-section connected between the outer surface of the thrust member and the surrounding inner surface of the guide structure. However, in a modulated bias unit the rolling diaphragm is subject to repeated flexing movements during each rotation of the bias unit with the result that, in the hostile downhole environment, rapid deterioration of the diaphragm can occur. This problem is exacerbated by the entrapment of abrasive particles from the drilling fluid in the folds of the rolling diaphragm, which may lead to very rapid abrasive wear and ultimately failure of the seal. In an endeavour to reduce this effect, it has been proposed, as described in British Patent Specification No. 2290097, to provide a further flexible annular diaphragm connected between the movable thrust member and the surrounding wall of the guide structure outwardly of said rolling diaphragm, to shield the rolling diaphragm from debris in the drilling fluid flowing past the bias unit. However, this arrangement has not proved entirely satisfactory, and does not, in any case, have any effect on the liability of the rolling diaphragm to fail as a result of its continual cyclic flexing when the bias unit is in use.

The present invention therefore sets out to provide an improved arrangement for alleviating or overcoming the above problems, as well as providing other advantages. Although the invention is particularly applicable to bias units, and more particularly to modulated bias units, it may also be of use in any form of downhole unit of the kind referred to above, having extendable formation-engaging members which are hydraulically actuated.

SUMMARY OF THE INVENTION

According to the invention there is provided a downhole unit, for use in boreholes in subsurface formations, comprising a main body, at least one formation-engaging member mounted on the main body for pivotal movement, about a pivot axis, outwardly and inwardly relative to the main body, a movable thrust member disposed inwardly of the formation-engaging member and movable outwardly and inwardly relative to a guide structure on the main body to transmit movement to the formation-engaging member, means for subjecting the thrust member to hydraulic pressure to effect said movement thereof, and a sealing device mounted on one of the thrust member and guide structure for substantially fluid-tight sliding engagement with the other of said components, at least the component which the sealing device slidably engages being in the form of a portion of a toroid centered on the pivot axis of the formation-engaging member. Since, according to the invention, the guide structure and/or thrust member is part-toroidal, all parts of the toroidal surface of the component move along an arc center on the pivot axis of the formation-engaging member as the thrust member moves inwardly and outwardly. Consequently, there may be little or no relative lateral movement between the surface of the component and the portion of the sealing device which it engages. The sealing device may therefore be a simple sliding seal and does not require to accommodate such lateral movement. Furthermore, at the same time the arrangement does not require any relative displacement between the thrust member and the formation-engaging member as the outward and inward movement takes place, so that the problem of relatively moving engagement between the components, and wear as a result of such engagement, is avoided.

In the present specification the terms "toroid" and "toroidal" will refer to an annular ring of any cross-sectional shape and are not limited to arrangements where the cross-section of the toroid is a circle or other conic section. However, it will be appreciated that the seal is likely to be most effective in the case where the toroid is of circular cross-section and such arrangement is therefore employed in the preferred embodiments.

The guide structure preferably comprises a passage along which the thrust member is movable, the sealing device being disposed between the external surface of the thrust member and the internal surface of the guide passage.

In this case the internal surface of the guide passage may be part-toroidal, the sealing device being mounted on the external surface of the thrust member and being in fluid-tight sliding engagement with the internal surface of the guide passage. Alternatively, the thrust member itself may be part-toroidal, the sealing device then being mounted on the internal surface of the guide passage and in fluid-tight sliding engagement with the external surface of the thrust member. It will be appreciated that, in a further alternative arrangement, both the guide passage and thrust member may be part-toroidal.

The sealing device preferably comprising a resiliently flexible sealing ring partly received in a peripheral groove on the component on which it is mounted, and having a portion projecting towards the other component and in fluid-tight sealing engagement therewith.

The peripheral surface of at least a part of the sealing device may also be in the form of a portion of a toroid centered on the pivot axis of the formation-engaging member, so as to be in close fitting engagement with the surface of the component which it slidably engages.

Alternatively or additionally the sealing device may include a wiper portion which, in cross-section, is tapered as it extends towards the surface of the component which it slidably engages, one side of the tapered portion lying against said surface.

The thrust member may be directly coupled to the formation-engaging member to transmit movement thereto. For example, it may be bolted or otherwise mechanically attached to the formation-engaging member or it may be integral therewith. Alternatively, an outer part of the thrust member may simply bear against an inner part of the formation-engation member.

The means for subjecting the thrust member to hydraulic pressure to effect movement thereof may comprise inlet means for supplying fluid under pressure to an expansible chamber of which the thrust member defines a movable wall, and outlet means for delivering fluid from said chamber to a lower pressure zone.

As previously mentioned, the downhole unit may be a bias unit for directional drilling wherein one or more formation-engaging members and thrust members are located around the periphery of the main body of the unit, means being provided to control the hydraulic pressure to which the thrust member or members are subjected in a manner to effect a lateral bias to the unit in a desired direction.

The bias unit may be a non-rotating unit, but may also be a rotating modulated bias unit having means for modulating the pressure of fluid supplied to the thrust member, or members, in synchronism with rotation of the unit, and in selected phase relation thereto whereby, as the bias unit rotates in use, the or each thrust member is moved outwardly at a selected rotational orientation of the bias unit so as to impart a desired lateral displacement thereto.

DETAILED DESCRIPTION OF THE PREFERRED EMBODIMENTS

As previously explained, the present invention will be described in relation to a modulated bias unit, but this is only one example of the different types of downhole unit having outwardly extending formation-engaging members to which the present invention relates.

Figure 1:
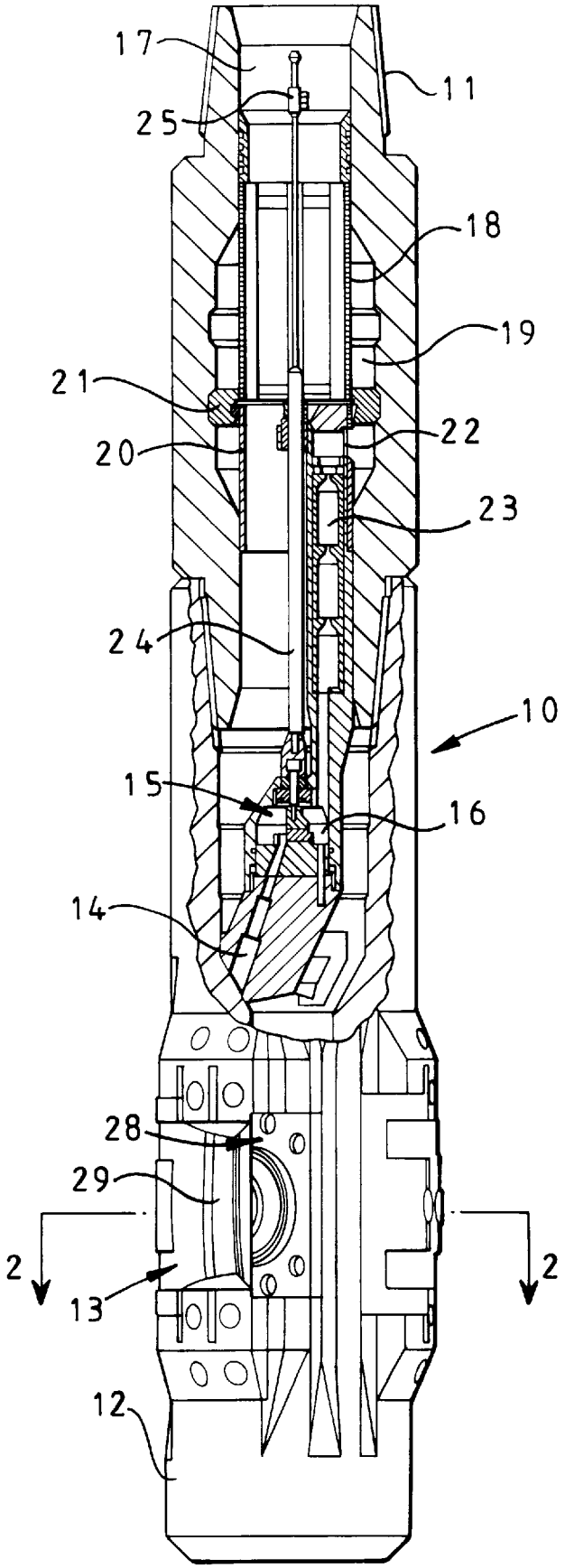
FIG. 1 is a part-longitudinal section, part side elevation of a modulated bias unit in accordance with the invention.

Referring to FIG. 1, the modulated bias unit comprises an elongate main body structure 10 provided at its upper end with the tapered externally threaded pin 11 for coupling the unit to a drill collar, incorporating a control unit, for example a roll stabilised instrument package, which is in turn connected to the lower end of the drill string. The lower end 12 of the body structure is formed with a tapered internally threaded socket shaped and dimensioned to receive the standard form of tapered threaded pin on a drill bit. In the aforementioned British Patent Specification No. 2259316 the exemplary arrangements described and illustrated incorporate the modulated bias unit in the drill bit itself. In the arrangement shown in the accompanying drawings, and in British Patent Specification No. 2290097, the bias unit is separate from the drill bit and may thus be used to effect steering of any form of drill bit which may be coupled to its lower end.

There are provided around the periphery of the bias unit, towards its lower end, three equally spaced hydraulic actuators 13, the operation of which will be described in greater detail below. Each hydraulic actuator 13 is supplied with drilling fluid under pressure through a passage 14 under the control of a rotatable disc valve 15 located in a cavity 16 in the body structure of the bias unit.

Drilling fluid delivered under pressure downwardly through the interior of the drill string, in the normal manner, passes into a central passage 17 in the upper part of the bias unit and flows outwardly through a cylindrical filter screen 18 into a surrounding annular chamber 19 formed in the surrounding wall of the body structure of the bias unit. The filter screen 18, and an imperforate tubular element 20 immediately below it, are supported by an encircling spider 21 within the annular chamber 19. Fluid flowing downwardly past the spider 21 to the lower part of the annular chamber 19 flows through an inlet 22 into the upper end of a vertical multiple choke unit 23 through which the drilling fluid is delivered downwardly at an appropriate pressure to the cavity 16.

The disc valve 15 is controlled by an axial shaft 24 which is connected by a coupling 25 to the outward shaft (not shown) of the aforementioned control unit (also not shown) in a drill collar connected between the pin 11 and the lower end of the drill string. The control unit may be of the kind described and claimed in British Patent Specification No. 2257182.

During steered drilling, the control unit maintains the shaft 24 substantially stationary at a rotational orientation which is selected, either from the surface or by a downhole computer program, according to the direction in which the bottom hole assembly, including the bias unit and the drill bit, is to be steered. As the bias unit 10 rotates around the stationary shaft 24 the disc valve 15 operates to deliver drilling fluid under pressure to the three hydraulic actuators 13 in succession. The hydraulic actuators are thus operated in succession as the bias unit rotates, each in the same rotational position, so as to displace the bias unit laterally away from the position where the actuators are operated. The selected rotational position of the shaft 24 in space thus determines the direction in which the bias unit is laterally displaced and hence the direction in which the drill bit is steered.

Figure 2:
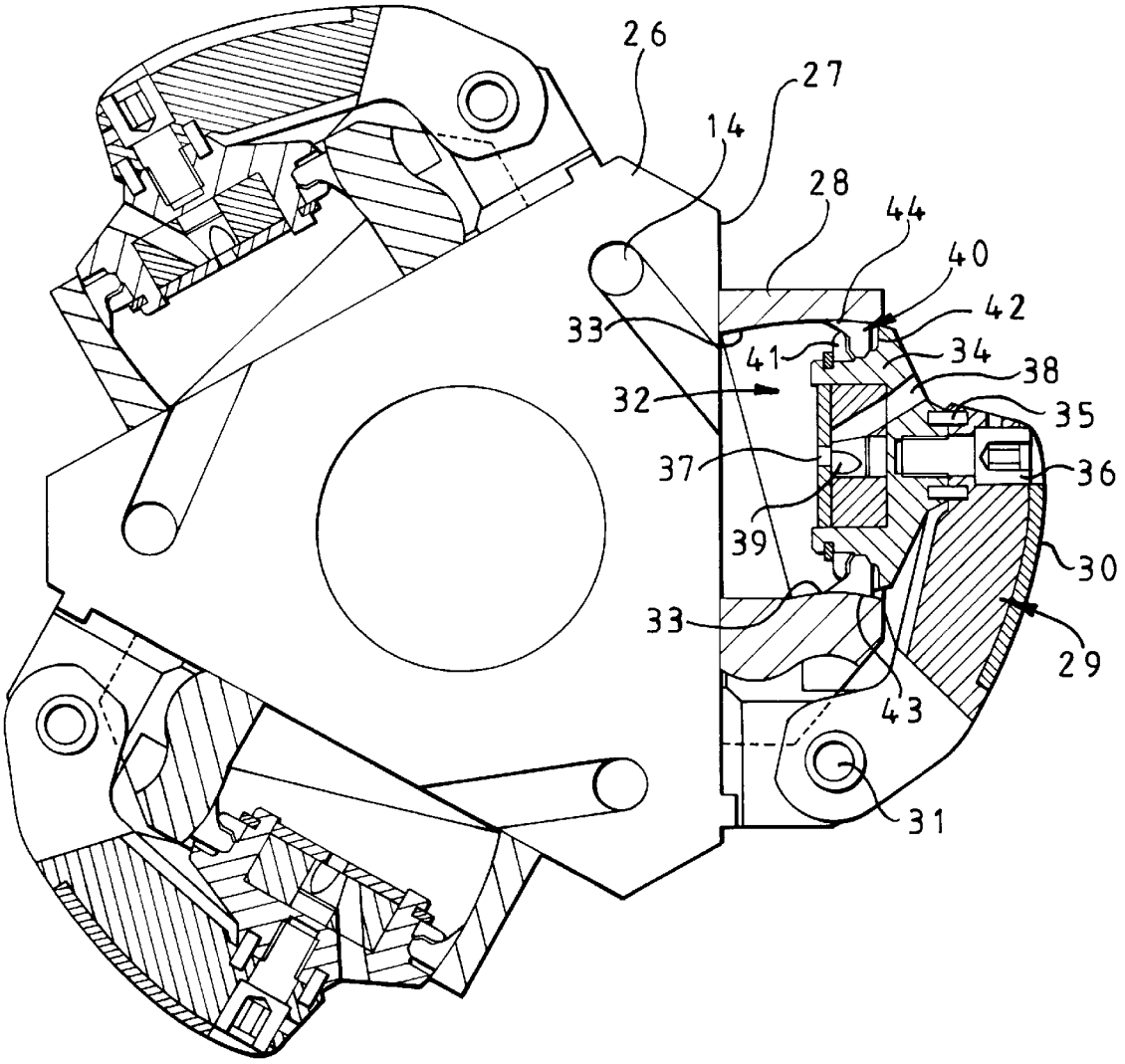
FIG. 2 is a horizontal cross-section through the bias unit, taken along the line 2—2 of FIG. 1.

The hydraulic actuators will now be described in greater detail with particular reference to FIG. 2. Referring to FIG. 2: at the location of the hydraulic actuators 13 the body structure 10 of the bias unit comprises a central core 26 of the general form of an equilateral triangle so as to provide three outwardly facing flat surfaces 27.

Mounted on each surface 27 is a rectangular support unit 28. A pad 29 having a part-cylindrically curved outer surface 30 is pivotally mounted on the support unit 28 by a pivot pin 31 the longitudinal axis of which is parallel to the longitudinal axis of the bias unit. (Although the invention does not exclude arrangements where the pivot axis is at 90°, or any other angle, to the longitudinal axis of the bias unit.)

Formed in the support unit 28 to one side of the pivot pin 31 is a circular cavity 32 which is in the form of a 12½° sector of a toroid centered on the pivot axis of the pivot pin 31, the curved internal wall of the toroid being indicated at 33. A movable thrust member 34 of generally circular form is located in the part-toroidal cavity 33 and is secured to the inner surface of the pad 29, remote from the pivot pin 31, by locating pins 35 and an hexagonal-socket screw 36. An outlet passage 37, 38 passes through the thrust member 28 via a choke device 39.

An annular sealing member 40 of a suitable resiliently flexible material, such as a heat and abrasion-resistant rubber, is mounted around the outer periphery of the thrust member 34 the inner portion of the sealing member 40 being clamped between a clamping ring 41 and an annular rebate 42 on the thrust member.

Part of the outer surface of the sealing ring 40 is part-toroidal, as indicated at 43, so as to be in close fitting engagement with the inner surface of the cavity 33 around the whole of its periphery. Another part of the sealing member is a wiper portion 44 which is tapered in cross-section as it extends towards the surface 33 of the cavity, one surface of the wiper portion bearing against the surface of the cavity, due to the resilience of the material of the sealing ring, to form the seal. In FIG. 2 the sealing ring 40 is shown diagrammatically in its undeformed shape.

The part of the cavity 32 inwardly of the thrust member 34 defines a chamber to which drilling fluid under pressure is supplied through the aforementioned associated passage 14 when the disc valve 15 is in the appropriate position. When the cavity 32 of each hydraulic unit is subjected to fluid under pressure, the associated thrust member 34 is urged outwardly and by virtue of its attachment to the pad 29 causes the pad to pivot outwardly and bear against the formation of the surrounding borehole and thus displace the bias unit in the opposite direction away from the location, for the time being, of the pad 29. As the bias unit rotates away from the orientation where a particular hydraulic actuator is operated, the next hydraulic actuator to approach that position is operated similarly to maintain the displacement of the bias unit in the same lateral direction. The pressure of the formation on the previously extended pad 29 thus increases, forcing that pad and associated thrust member 34 inwardly again, and during this inward movement fluid is expelled from the cavity 32 through the outlet passage 37, 38 and choke 39. There may be provided three circumferentially spaced diverging passages 38 leading from the choke unit 39 to three outlets respectively in the outwardly facing surface of the thrust member 34.

Since the cavity 32 is part-toroidal and is centered about the pivot axis of the pad 29, movement of the thrust member 34 around the part-toroidal section of the cavity does not result in any change in the deformation of the sealing member 40 since the sealing member, and the parts of the surface 33 which it engages, remain at the same distance from the pivot axis. The sealing member does not therefore have to be of a design such that it may accommodate tilting and lateral displacement between the thrust member 34 and the cavity 32. The sealing member may therefore be of a basically simple and reliable known design apart from the provision of the part-toroidal portion 43 of the sealing ring, which is desirable but not essential to the invention.

The provision of the part-toroidal cavity also allows the thrust member 34 to be rigidly secured to the pad 29 so that no wear occurs as a result of relative displacement between the thrust member and pad during operation.

Figure 3:
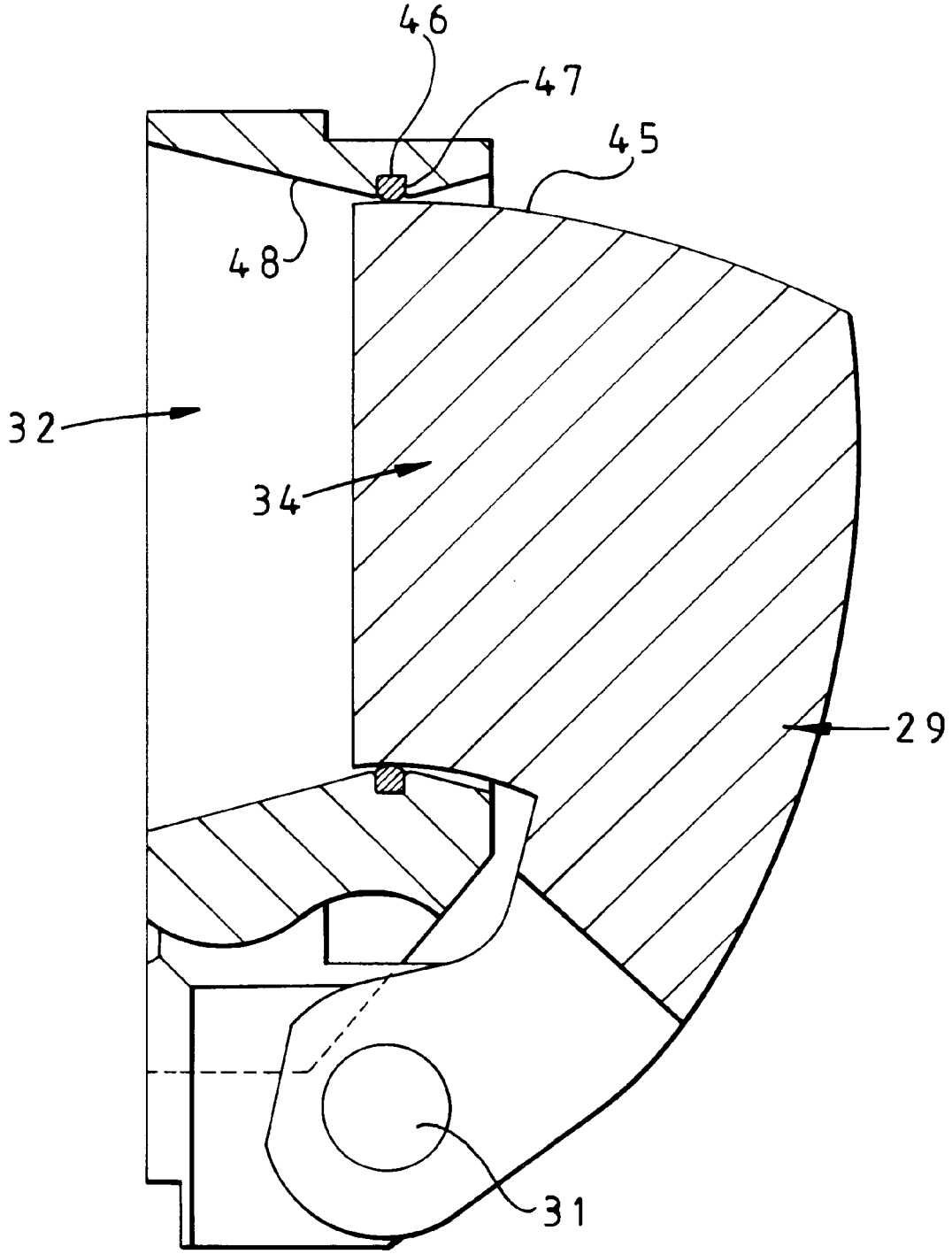
FIG. 3 is a similar cross-section to FIG. 2 of an alternative arrangement.

FIG. 3 shows a modified version of the arrangement of the hydraulic actuator of FIG. 2 and similar components bear the same reference numerals. In this case the thrust member 34 is integral with the formation-engaging pad 29.

In the modified arrangement the cavity 32 in the support unit 28 is generally frustoconical in shape and it is the outer surface 45 of the thrust member 34 which is part-toroidal and centered on the pivot axis of the pivot pin 31. In this case a simple sealing ring 46 is fixedly retained within a groove 47 in the internal wall 48 of the cavity 32 and bears resiliently against the outer surface 45 of the thrust member. The part of the sealing ring 46 which bears on the surface 45 is part-circular in cross-section.

In this case the sealing ring 46 remains stationary while the thrust member 28 moves through it in an arc centered on the pivot axis of the pad 29 so that, again, there is no radial distortion of the sealing ring as the thrust member moves through it.

Other forms of sealing device may be employed, for example the device may comprise a central resilient seal portion on the inner and outer sides of which are disposed scraper portions having scraping line contact with the surface which the seal engages.

It will be appreciated that, in order to ensure that there is no significant relative lateral displacement between the thrust member and seal, it is important that there should be the absolute minimum of axial and lateral play between the pivot pin 31 and the bearings in which it is located.

Although it is convenient for the general plane of the sealing ring to pass through the pivot axis of the formation-engaging pad, as shown in FIGS. 2 and 3, this is not essential.

Whereas the present invention has been described in particular relation to the drawings attached hereto, it should be understood that other and further modifications, apart from those shown or suggested herein, may be made within the scope and spirit of the present invention.

What is claimed:

1. A downhole unit, for use in boreholes in subsurface formations, comprising a main body, at least one formation-engaging member mounted on the main body for pivotal movement, about a pivot axis, outwardly and inwardly relative to the main body, a movable thrust member disposed inwardly of the formation-engaging member and movable outwardly and inwardly relative to a guide structure on the main body to transmit movement to the formation-engaging member, means for subjecting the thrust member to hydraulic pressure to effect said movement thereof, and a sealing device mounted on one of the thrust member and guide structure for substantially fluid-tight sliding engagement with the other of said components, at least the component which the sealing device slidably engages being in the form of a portion of a toroid centered on the pivot axis of the formation-engaging member.

2. A downhole unit according to claim 1, wherein the guide structure comprises a passage along which the thrust member is movable, the sealing device being disposed between the external surface of the thrust member and the internal surface of the guide passage.

3. A downhole unit according to claim 2, wherein the internal surface of the guide passage is part-toroidal, the sealing device being mounted on the external surface of the thrust member and being in fluid-tight sliding engagement with the internal surface of the guide passage.

4. A downhole unit according to claim 2, wherein the thrust member is part-toroidal, the sealing device being mounted on the internal surface of the guide passage and in fluid-tight sliding engagement with the external surface of the thrust member.

5. A downhole unit according to claim 2, wherein both the guide passage and thrust member are part-toroidal.

6. A downhole unit according to claim 1, wherein the sealing device comprises a resiliently flexible sealing ring partly received in a peripheral groove on the component on which it is mounted, and having a portion projecting towards the other component and in fluid-tight sealing engagement therewith.

7. A downhole unit according to claim 1, wherein the peripheral surface of at least a part of the sealing device is in the form of a portion of a toroid centered on the pivot axis of the formation-engaging member, so as to be in close fitting engagement with the surface of the component which it slidably engages.

8. A downhole unit according to claim 1, wherein the sealing device includes a wiper portion which, in cross-section, is tapered as it extends towards the surface of the component which it slidably engages, one side of the tapered portion lying against said surface.

9. A downhole unit according to claim 1, wherein the thrust member is directly coupled to the formation-engaging member to transmit movement thereto.

10. A downhole unit according to claim 9, wherein the thrust member is mechanically attached to the formation-engaging member.

11. A downhole unit according to claim 9, wherein the thrust member is integral with the formation-engaging member.

12. A downhole unit according to claim 9, wherein outer part of the thrust member bears against an inner part of the formation-engaging member.

13. A downhole unit according to claim 1, wherein the means for subjecting the thrust member to hydraulic pressure to effect movement thereof comprise inlet means for supplying fluid under pressure to an expansible chamber of which the thrust member defines a movable wall, and outlet means for delivering fluid from said chamber to a lower pressure zone.

14. A downhole unit according to claim 1, comprising a bias unit for directional drilling wherein one or more formation-engaging members and thrust members are located around the periphery of the main body of the unit, means being provided to control the hydraulic pressure to which the thrust member or members are subjected in a manner to effect a lateral bias to the unit in a desired direction.

15. A downhole unit according to claim 14, wherein the bias unit is a non-rotating unit.

16. A downhole unit according to claim 14, wherein the bias unit is a rotating modulated bias unit having means for modulating the pressure of fluid supplied to the thrust member, or members, in synchronism with rotation of the unit, and in selected phase relation thereto whereby, as the bias unit rotates in use, the or each thrust member is moved outwardly at a selected rotational orientation of the bias unit so as to impart a desired lateral displacement thereto.

* * * * *